US011373589B1

(12) United States Patent
Yeh et al.

(10) Patent No.: US 11,373,589 B1
(45) Date of Patent: Jun. 28, 2022

(54) DISPLAY WITH PIXEL DEVICES EMITTING LIGHT SIMULTANEOUSLY

(71) Applicant: Lextar Electronics Corporation, Hsinchu (TW)

(72) Inventors: Chien-Nan Yeh, Hsinchu (TW); Chih-Hao Lin, Hsinchu (TW); Cheng-Te Lin, Hsinchu (TW); Ku-Cheng Lin, Hsinchu (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 17/444,671

(22) Filed: Aug. 9, 2021

(30) Foreign Application Priority Data

Mar. 8, 2021 (CN) ..... 202110250353.7

(51) Int. Cl.
*G09G 3/32* (2016.01)

(52) U.S. Cl.
CPC ..... *G09G 3/32* (2013.01); *G09G 2310/08* (2013.01); *G09G 2320/0233* (2013.01)

(58) Field of Classification Search
CPC ..... G09G 3/32; G09G 2310/08; G09G 2320/0233
See application file for complete search history.

(56) References Cited

U.S. PATENT DOCUMENTS

2016/0148578 A1* 5/2016 Kishi ..... G09G 3/3291 345/212
2017/0017326 A1* 1/2017 Wu ..... G09G 3/3677
2017/0188427 A1 6/2017 Cok et al.
2017/0315659 A1* 11/2017 Kuroiwa ..... G06F 3/04184
2017/0330509 A1* 11/2017 Cok ..... G09G 3/2014
2018/0137804 A1* 5/2018 Choi ..... G09G 3/2092
2018/0181244 A1* 6/2018 Sato ..... G09G 3/3677
2018/0190180 A1* 7/2018 Shang ..... G09G 3/3266
2018/0197471 A1* 7/2018 Rotzoll ..... H01L 25/0753
2018/0261149 A1 9/2018 Lin
2019/0371229 A1 12/2019 Wang et al.
2020/0118989 A1 4/2020 Wang et al.

FOREIGN PATENT DOCUMENTS

CN 103594054 A 2/2014
TW 200718347 A 5/2007
TW 200834876 A 8/2008
TW 201515177 A 4/2015
TW 201833890 A 9/2018
TW 202015261 A 4/2020

* cited by examiner

*Primary Examiner* — Andrew Sasinowski
(74) *Attorney, Agent, or Firm* — CKC & Partners Co., LLC

(57) ABSTRACT

A display includes first and second pixel devices. The first pixel device includes a first control circuit and a first light emitting circuit. The first control circuit generates a first light emitting signal according to a first clock signal and a data signal during a first period. The first light emitting circuit emits light according to the first light emitting signal during second and third periods. The second pixel device includes a second control circuit and a second light emitting circuit. The second control circuit generates a second light emitting signal according to a second clock signal and the data signal during the second period. The second light emitting circuit is coupled to the second control circuit and emits light according to the second light emitting signal during the third period. The first period to the third period are arranged continuously in order.

20 Claims, 12 Drawing Sheets

DISPLAY WITH PIXEL DEVICES EMITTING LIGHT SIMULTANEOUSLY

CROSS-REFERENCE TO RELATED APPLICATION

This application claims priority to China Application Serial Number 202110250353.7, filed Mar. 8, 2021, which is herein incorporated by reference in its entirety.

BACKGROUND

Technical Field

The present disclosure relates to display technology. More particularly, the present disclosure relates to a display with pixel devices.

Description of Related Art

Conventional light emitting diode (LED) displays are driven by a passive matrix (PM) to control brightness and scale of pixels. However, requirements of ultra-fine pitches (UFP) of the displays increase nowadays, and the corresponding integrated circuits (IC) are highly integrated IC. The IC is required to be connected to multiple pixel devices and result in following problems. Circuit layouts of the displays are complicated and required multiple layers of printed circuit board (PCB) for implementation. When pitches are smaller than 0.6 mm, the process technology of driving IC and PCB faces a barrier, which is a disadvantage of marketing. PM driving lights LED by scanning with multitasking instantaneous operation, which easily results in strobe problems. A large amount of scanning requires high switching rate of the LED. Besides, connecting the multiple pixel devices requires high IC power. Therefore, how to design a new display to solve the above-mentioned shortcomings is an urgent issue for the industry.

SUMMARY

The present disclosure provides a display. The display includes pixel driving circuits coupled to each other in series. The pixel driving circuits includes a first pixel device and a second pixel device. The first pixel device includes a first control circuit and a first light emitting circuit. The first control circuit is configured to generate a first light emitting signal according to a first clock signal and a data signal during a first period. The first light emitting circuit is coupled to the first control circuit and configured to emit light according to the first light emitting signal during a second period and a third period. The second pixel device includes a second control circuit and a second light emitting circuit. The second control circuit is configured to generate a second light emitting signal according to a second clock signal and the data signal during the second period. The second light emitting circuit is coupled to the second control circuit and configured to emit light according to the second light emitting signal during the third period. The first period to the third period are arranged continuously in order.

The present disclosure provides a display. The display includes pixel driving circuits coupled to each other in series. The pixel driving circuits includes a first pixel device and a second pixel device. The first pixel device includes a first control circuit and a first light emitting circuit. The first control circuit is configured to output a first bit of a data signal according to a first clock signal during a first period. The first light emitting circuit is coupled to the first control circuit and configured to emit light according to the first bit during a second period and a third period. The second pixel device includes a second control circuit and a second light emitting circuit. The second control circuit is configured to output the first bit according to a second clock signal during the second period. The second light emitting circuit is coupled to the second control circuit and configured to emit light according to the first bit during the third period and a fourth period. The first control circuit is further configured to output a second bit of the data signal according to the first clock signal during the fourth period. The first period to the fourth period are arranged continuously in order.

It is to be understood that both the foregoing general description and the following detailed description are by examples, and are intended to provide further explanation of the disclosure as claimed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
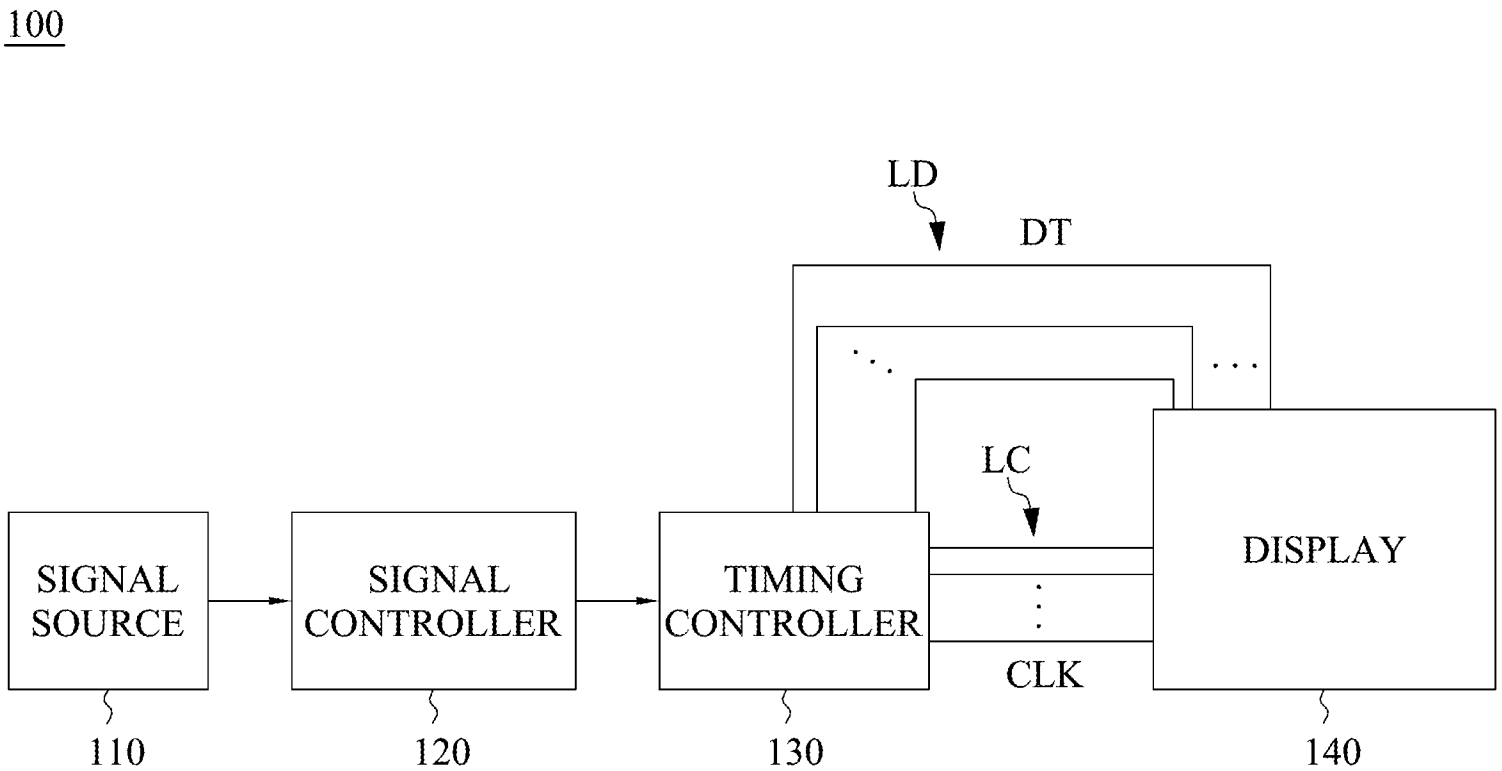
FIG. 1 is a schematic diagram of a display system according to one embodiment of this disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The terms applied throughout the following descriptions and claims generally have their ordinary meanings clearly established in the art or in the specific context where each term is used. Those of ordinary skill in the art will appreciate that a component or process may be referred to by different names. Numerous different embodiments detailed in this specification are illustrative only, and in no way limit the scope and spirit of the disclosure or of any exemplified term.

It is worth noting that terms such as "first" and "second" used herein to describe various elements or processes aim to distinguish one element or process from another. However, the elements, processes and the sequences thereof should not be limited by these terms. For example, a first element could be termed as a second element, and a second element could be similarly termed as a first element without departing from the scope of the present disclosure.

In the following discussion and in the claims, the terms "comprising," "including," "containing," "having," "involving," and the like are to be understood to be open-ended, that is, to be construed as including but not limited to. As used herein, instead of being mutually exclusive, the term "and/or" includes any of the associated listed items and all combinations of one or more of the associated listed items.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a schematic diagram of a display system 100 according to one embodiment of this disclosure. As shown by way of example in FIG. 1, the display device 100 includes a signal source 110, a signal controller 120, a timing controller 130 and a display 140.

In some embodiments, the signal source 110 is configured to provide signals, such as high definition multimedia interface (HDMI) signal and/or digital visual interface (DVI) signal. The signal controller 120 is configured to operate according to the signals provided by the signal source 110, such as processing the signals by the technology of the serial peripheral interface bus (SPI), the inter-integrated circuit (I2C) and/or the low-voltage differential signaling (LVDS). In some embodiments, the signal controller 120 is implemented as an application specific integrated circuit (ASIC) and/or a field programmable gate array (FPGA).

In some embodiments, the timing controller 130 is configured to operate according to the signals processed by the signal controller 120. As shown by way of example in FIG. 1, the timing controller 130 is configured to generate clock signals CLK and data signals DT, and configured to output the clock signals CLK and the data signals DT via clock lines LC and data lines LD. Various numbers of the clock signals CLK, the data signals DT, the clock lines LC and the data lines LD are contemplated as being within the scope of the present disclosure.

In some embodiments, the display 140 is coupled to the timing controller 130 via the clock lines LC and the data lines LD. In some embodiments, the display 140 is configured to perform data writing operation and light emitting operation according to the clock signals CLK and the data signals DT.

Figure 2A:
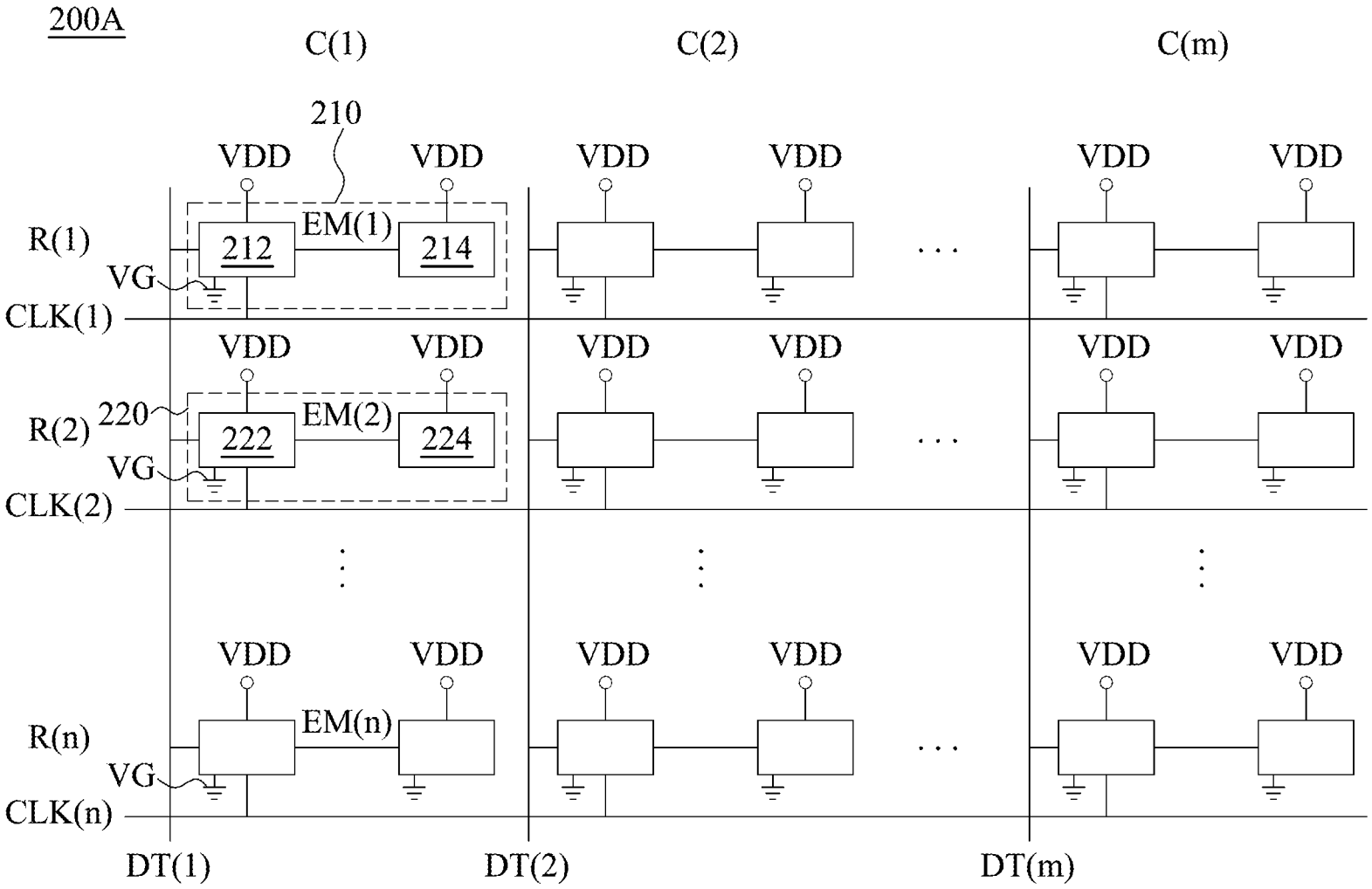
FIG. 2A is a schematic diagram of a display according to one embodiment of this disclosure.

FIG. 2A is a schematic diagram of a display 200A according to one embodiment of this disclosure. As shown by way of example in FIG. 2A, the display 200A is configured to operate according to clock signals CLK(1)-CLK(n) and data signals DT(1)-DT(m). Referring to FIG. 2A and FIG. 1, the display 200A, the clock signals CLK(1)-CLK(n) and the data signals DT(1)-DT(m) are embodiments of the display 140, the clock signals CLK and the data signals DT shown in FIG. 1, respectively. It is noted that m and n are positive integer.

As shown by way of example in FIG. 2A, the display 200A includes pixel device columns C(1)-C(m) and pixel device rows R(1)-R(n). Each of the pixel device columns C(1)-C(m) and the pixel device rows R(1)-R(n) includes multiple pixel devices. For example, the pixel device column C(1) includes pixel devices 210 and 220.

As shown by way of example in FIG. 2A, the pixel device columns C(1)-C(m) are configured to receive the data signals DT(1)-DT(m), respectively, and the pixel device rows R(1)-R(n) are configured to receive the clock signals CLK(1)-CLK(n), respectively. For example, the pixel device 210 included in the pixel device column C(1) and the pixel device row R(1) is configured to receive the data signal DT(1) and the clock signal CLK(1) to operate. The pixel device 220 included in the pixel device column C(1) and the pixel device row R(2) is configured to receive the data signal DT(1) and the clock signal CLK(2) to operate.

As shown by way of example in FIG. 2A, each of the pixel devices in the display 200A includes a control circuit and a light emitting circuit. The control circuit is configured to receive a corresponding one of the data signals DT(1)-DT(m) and a corresponding one of the clock signals CLK(1)-CLK(n) to generate a light emitting signal. The light emitting circuit is coupled to the control circuit, and configured to perform light emitting operation according to the light emitting signal.

As shown by way of example in FIG. 2A, the pixel device 210 includes a control circuit 212 and a light emitting circuit 214. The control circuit 212 is configured to receive the data signal DT(1) and the clock signal CLK(1) to generate a light emitting signal EM(1). The light emitting circuit 214 is coupled to the control circuit 212, and configured to emit light according to the light emitting signal EM(1).

As shown by way of example in FIG. 2A, the pixel device 220 includes a control circuit 222 and a light emitting circuit 224. The control circuit 222 is configured to receive the data signal DT(1) and the clock signal CLK(2) to generate a light emitting signal EM(2). The light emitting circuit 224 is coupled to the control circuit 222, and configured to emit light according to the light emitting signal EM(2).

In some embodiments, the light emitting signal EM(1) corresponds to a result of the data signal DT(1) and the clock signal CLK(1) performing an AND operation, and the light emitting signal EM(2) corresponds to a result of the data signal DT(1) and the clock signal CLK(2) performing an AND operation.

In the embodiment shown in FIG. 2A, each of the control circuits, such as the control circuits 212 or 222, is coupled to a power voltage VDD and a ground voltage VG. Each of the light emitting circuits, such as the light emitting circuit 214 or 224, is coupled to the power voltage VDD, but the present disclosure is not limited to such embodiments. In various embodiments, the control circuits, the light emitting circuits, the power voltage VDD and the ground voltage VG may have different coupling relationship.

In some previous approaches, a control circuit is coupled to multiple pixel devices to operate, such that errors may occurs easily, the circuit is complicated, and a printed circuit board (PCB) with larger number of layers is required for implementation.

Compared to the above approaches, in some embodiments of the present disclosure, active matrix (AM) is implemented. Each of the control circuits are connected to the corresponding light emitting circuit to operate, such as the control circuits 212 and 222 are connected to the light emitting circuit 214 and 224, respectively. As a result, the errors of currents and the complexity of the circuit are reduced, such that the circuit may be implemented by a PCB with less number of layers and costs are reduced correspondingly.

Figure 2B:
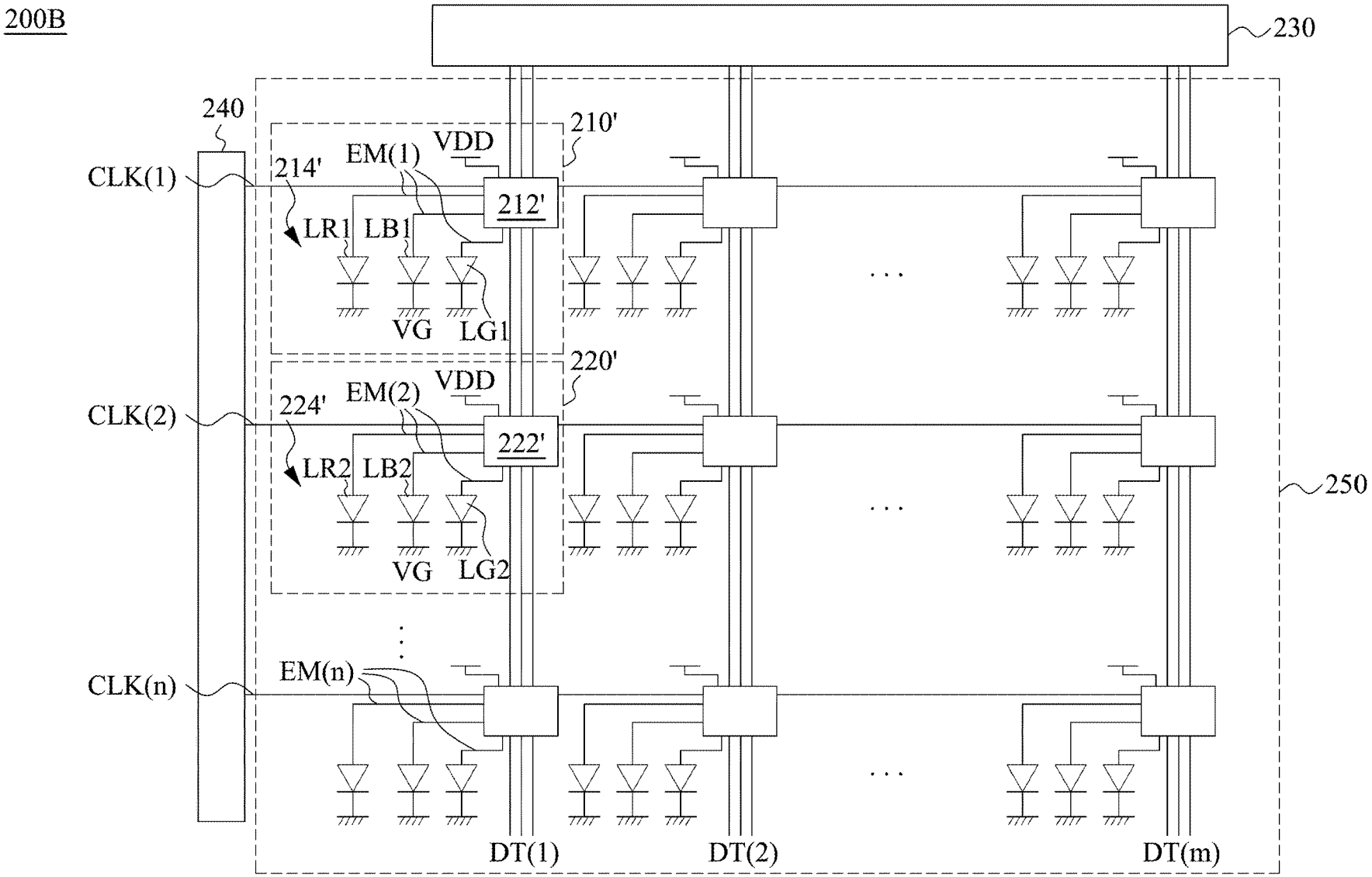
FIG. 2B is a schematic diagram of a display according to one embodiment of this disclosure.

FIG. 2B is a schematic diagram of a display 200B according to one embodiment of this disclosure. Referring to FIG. 2B and FIG. 1, the display 200B is an embodiment of the display 140 shown in FIG. 1. Referring to FIG. 2B and FIG. 2A, the display 200B is an alternative embodiment of the display 200A shown in FIG. 2A.

As shown by way of example in FIG. 2B, the display 200B includes a source driver 230, a gate driver 240 and a pixel device group 250 including multiple pixel devices. In some embodiments, the pixel device group 250 is configured to perform light emitting operation according to signals provided by the source driver 230 and the gate driver 240. In some embodiments, the source driver 230 is configured to provide the data signals DT(1)-DT(m), and the gate driver 240 is configured to provide the clock signals CLK(1)-CLK (n).

As shown by way of example in FIG. 2B, the pixel device group 250 includes pixel devices 210' and 220'. Referring to FIG. 2A and FIG. 2B, the pixel devices 210' and 220' are embodiments of the pixel devices 210 and 220 shown in FIG. 2A, respectively. In some embodiments, the pixel device 210' is configured to receive the data signal DT(1) and the clock signal CLK(1), and pixel device 220' is configured to receive the data signal DT(1) and the clock signal CLK(2).

As shown by way of example in FIG. 2B, the pixel device 210' includes a control circuit 212' and a light emitting circuit 214', and the pixel device 220' includes a control circuit 222' and a light emitting circuit 224'. In some embodiments, the control circuit 212' is configured to receive the data signal DT(1) and the clock signal CLK(1) to generate a light emitting signal EM(1). The light emitting circuit 214' is coupled to the control circuit 212', and configured to emit light according to the light emitting signal EM(1). The control circuit 222' is configured to receive the data signal DT(1) and the clock signal CLK(2) to generate a light emitting signal EM(2). The light emitting circuit 224' is coupled to the control circuit 222', and configured to emit light according to the light emitting signal EM(2).

The display may be implemented as an LED display, and the pixels may be constructed by LED. As shown by way of example in FIG. 2B, the light emitting circuit 214' includes three light emitting elements LR1, LB1 and LG1. The light emitting circuit 224' includes three light emitting elements LR2, LB2 and LG2. The light emitting elements LR1, LB1 and LG1 emit red light, blue light and green light, respectively, to construct a pixel. The light emitting elements LR2, LB2 and LG2 emit red light, blue light and green light, respectively, to construct a pixel. The light emitting elements LR1, LB1, LG1 LR2, LB2 and LG2 may be implemented as LED or micro LED. In various embodiments, the light emitting circuits 214' and 224' include other numbers of light emitting elements configured to emit various colors of light to construct a pixel of the display. For example, the light emitting circuit 214' includes four light emitting elements LR1, LB1, LG1 and LY1 emitting red light, blue light, green light and yellow light, respectively.

As shown by way of example in FIG. 2B, in some embodiments, the control circuit 212' and 222' are configured to receive the power voltage VDD, and the light emitting elements LR1, LB1, LG1 LR2, LB2 and LG2 are configured to receive the ground voltage VG.

In some embodiments, the control circuits 212' and 222' may be implemented as integrated circuit (IC) or micro IC.

Figure 2C:
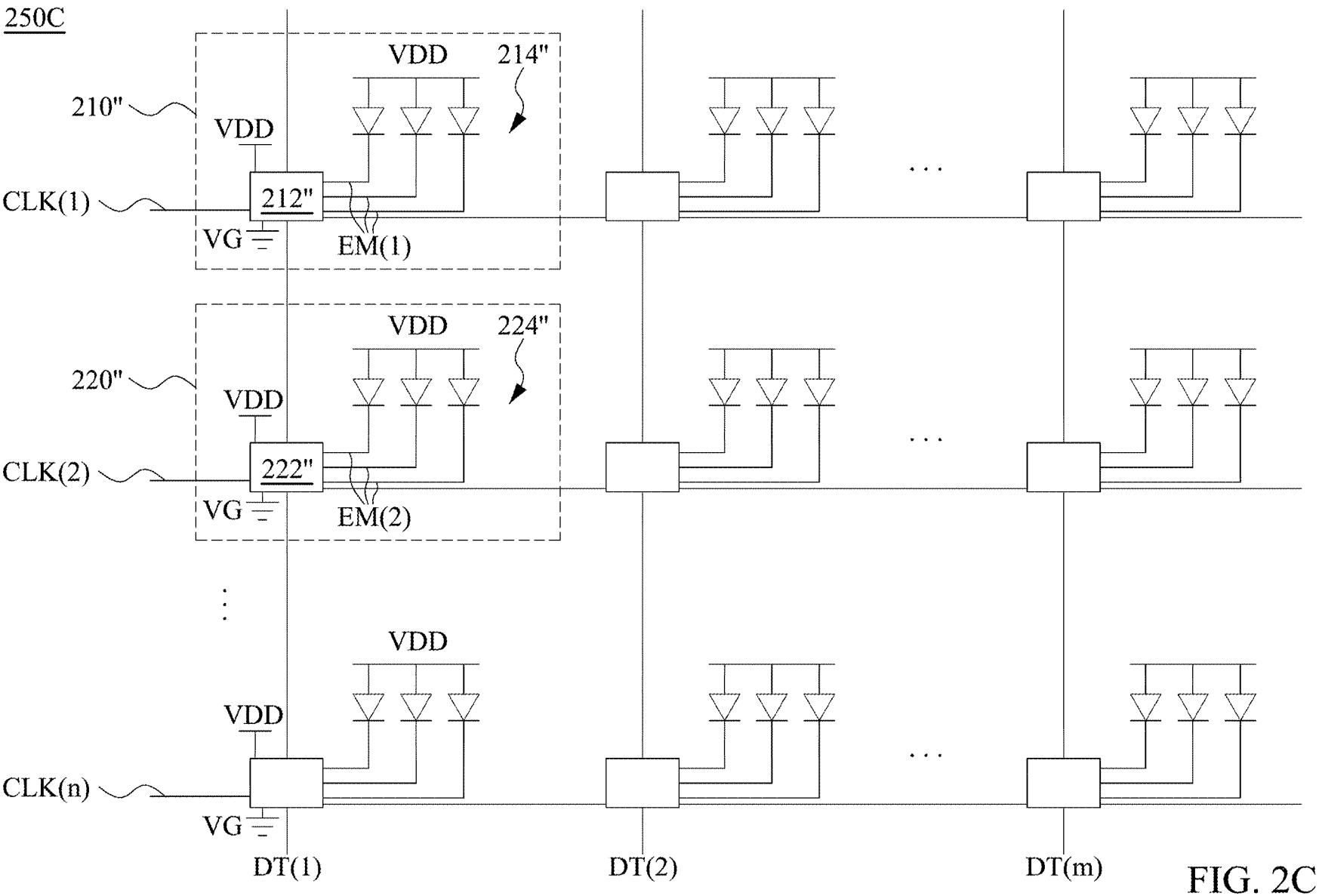
FIG. 2C is a schematic diagram of a pixel device group according to one embodiment of this disclosure.

FIG. 2C is a schematic diagram of a pixel device group 250C according to one embodiment of this disclosure. Referring to FIG. 2B and FIG. 2C, the pixel device group 250C is an alternative embodiment of the pixel device group 250 shown in FIG. 2B.

As shown by way of example in FIG. 2C, the pixel device group 250C includes the pixel devices 210" and 220". Referring to FIG. 2B and FIG. 2C, the pixel devices 210" and 220" are alternative embodiments of the pixel devices 210' and 220' shown in FIG. 2B, respectively. The pixel device group 250C, the pixel devices 210" and 220" are similar to pixel device group 250, the pixel devices 210' and 220', respectively, and thus similar aspects are not repeated for brevity.

As shown by way of example in FIG. 2C, the pixel device 210" includes a control circuit 212" and a light emitting circuit 214", and the pixel device 220" includes a control circuit 222" and a light emitting circuit 224". In some embodiments, the control circuit 212" is configured to receive the data signal DT(1) and the clock signal CLK(1) to generate the light emitting signal EM(1). The light emitting circuit 214" is coupled to the control circuit 212", and configured to emit light according to the light emitting signal EM(1). The control circuit 222" is configured to receive the data signal DT(1) and the clock signal CLK(2) to generate a light emitting signal EM(2). The light emitting circuit 224" is coupled to the control circuit 222", and configured to emit light according to the light emitting signal EM(2).

In the embodiment shown in FIG. 2C, the control circuits 212" or 222" are configured to receive the power voltage VDD and the ground voltage VG, and the light emitting circuit 214" or 224" are configured to receive the power voltage VDD.

Figure 3:
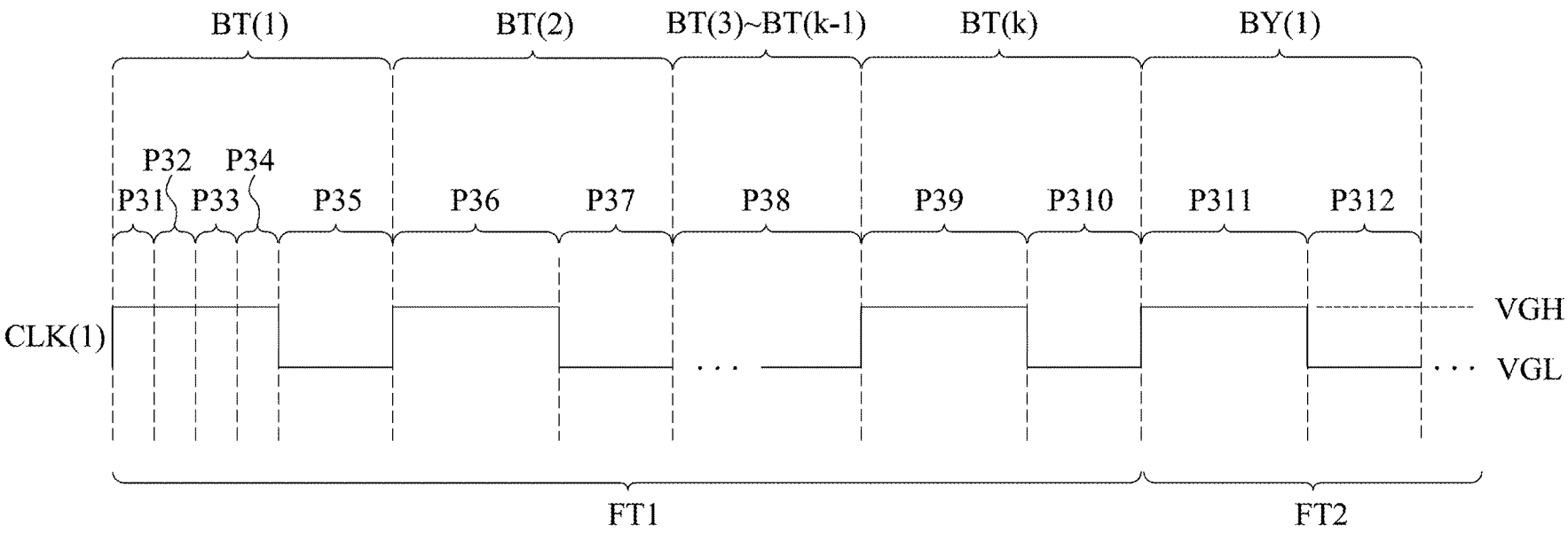
FIG. 3 is a timing diagram of the pixel device performing a light emitting operation according to one embodiment of this disclosure.

FIG. 3 is a timing diagram 300 of the pixel device performing a light emitting operation according to one embodiment of this disclosure. The timing diagram 300 includes periods P31-P312 in order. In some embodiments, the timing diagram 300 corresponds to signals shown in FIG. 2A, such as operations of the clock signals CLK(1) or CLK(2). For illustration purpose, an example of the pixel device 210' receiving the clock signal CLK(1) is provided in the embodiment shown by FIG. 3.

As shown by way of example in FIG. 3, during the periods P31-P34, the clock signal CLK(1) has an enable voltage level VGH, such that the control circuit 212' generates the light emitting signal EM(1) according to a first data bit BT(1) of the data signal DT(1). Correspondingly, during the period P35, the light emitting circuit 214' performs a light emitting operation according to the light emitting signal EM(1) corresponding to the first data bit BT(1). In other word, the control circuit 212' outputs the first data bit BT(1) during the periods P31-P34, and the light emitting circuit 214' emits light according to the first data bit BT(1).

More specifically, during the period P31, the control circuit 212' generates the light emitting signal EM(1), which corresponds to whether the light emitting element LR1 emits light during the period P35, according to the first data bit BT(1). For example, when the data signal DT(1) has an enable voltage level during the period P31, that is, when the first data bit BT(1) has a logic high level, the light emitting element LR1 emits light during the period P35. On the contrary, when the data signal DT(1) has an disable voltage level during the period P31, that is, when the first data bit BT(1) has a logic low level, the light emitting element LR1 does not emit light during the period P35. Further details of the data signal DT(1) and the first data bit BT(1) are described below in embodiments with reference to FIG. 4B.

Similarly, during the period P32, the control circuit 212' generates, according to the first data bit BT(1), the light emitting signal EM(1) which corresponds to whether the light emitting element LG1 emits light during the period P35. During the period P33, the control circuit 212' generates, according to the first data bit BT(1), the light emitting signal EM(1) which corresponds to whether the light emitting element LB1 emits light during the period P35.

During the period P34, the control circuit 212' generates, according to the first data bit BT(1), the light emitting signal EM(1) which corresponds to a current level of a current received by the light emitting circuit 214' when the light emitting circuit 214' emits light. For example, when the data signal DT(1) has an enable voltage level during the period P34, that is, when the first data bit BT(1) has a logic high level, a current flowing through the light emitting circuit 214' has a first current level during the period P35, such that at least one of the light emitting elements LR1, LB1 and LG1 that emits light has a first brightness level. On the contrary, when the data signal DT(1) has an disable voltage level during the period P34, that is, when the first data bit BT(1) has a logic low level, the current flowing through the light emitting circuit 214' has a second current level during the period P35, such that at least one of the light emitting elements LR1, LB1 and LG1 that emits light has a second brightness level. The first current level is different from the second current level, and the first brightness level is different from the second brightness level. In other word, the control circuit 212' adjusts the brightness level of the light emitting circuit 214' during the period P35 according to the first data bit BT(1).

During the period P36, the clock signal CLK(1) has an enable voltage level VGH, such that the control circuit 212' generates the light emitting signal EM(1) according to a second data bit BT(2) of the data signal DT(1). Correspondingly, during the period P37, the light emitting circuit 214' performs a light emitting operation according to the light emitting signal EM(1) corresponding to the second data bit BT(2). In other word, the control circuit 212' outputs the second data bit BT(2) during the period P36, and the light emitting circuit 214' emits light according to the second data bit BT(2).

The operations of the control circuit 212' and the light emitting circuit 214' during the periods P36-P37 corresponding to the first data bit BT(1) are similar to the operations during the periods P31-P35 corresponding to the second data bit BT(2). For example, during the period P36, the control circuit 212' generates, according to the second data bit BT(2), the light emitting signal EM(1) which corresponds to whether each of the light emitting elements LR1, LG1 and LB1 emits light during the period P37. Therefore, similar aspects of these operations are not repeated for brevity.

During the period P38, the control circuit 212' and the light emitting circuit 214' perform operations similar to those of the periods P36-P37 corresponding to each of a third data bit BT(3) to a (k−1)th data bit BT(k−1) in order, such that the light emitting circuit 214' performs light emitting operations corresponding to each of the third data bit BT(3) to the (k−1)th data bit BT(k−1) in order. It is noted that k is a positive integer larger than one.

During the period P39-P310, the control circuit 212' and the light emitting circuit 214' perform operations similar to those of the periods P36-P37, such that the light emitting circuit 214' performs light emitting operations corresponding to a kth data bit BT(k).

In some embodiments, a time length of the periods P31-P310 corresponds to a frame time, such as a frame time FT1 shown in FIG. 3.

In some embodiments, the control circuit 212' and the light emitting circuit 214' perform operations similar to those of the frame time FT1 during a frame time FT2 after the frame time FT1. For example, during the periods P311-P312, the control circuit 212' and the light emitting circuit 214' perform a light emitting operation according to a first data bit BY(1) of the data signal DT(1). The first data bit BY(1) may be different from the first data bit BT(1).

In some previous approaches, during a frame time, a control circuit generates multiple light emitting signals corresponding to multiple data bits according to the data bits of a data signal, and then a light emitting circuit emits light. The approaches described above have lower flexibility, and the algorithm configured to operate the control circuit cannot be changed after the IC circuit design is finished.

Compared to the above approaches, in some embodiments of the present disclosure, a frame time is divided into multiple sub-periods, such as the periods P31-P35, P36-P37 and P39-P310. During each of the sub-periods, the control circuit 212' and the light emitting circuit 214' perform a light emitting operation according to the data bits BT(1)-BT(k). As a result, the ways of the light emitting circuit 214' emitting light can be updated during each of the sub-periods. The embodiments of the present disclosure have higher flexibility, and the ways of emitting light can be changed as cooperating with different algorithms.

Figure 4A:
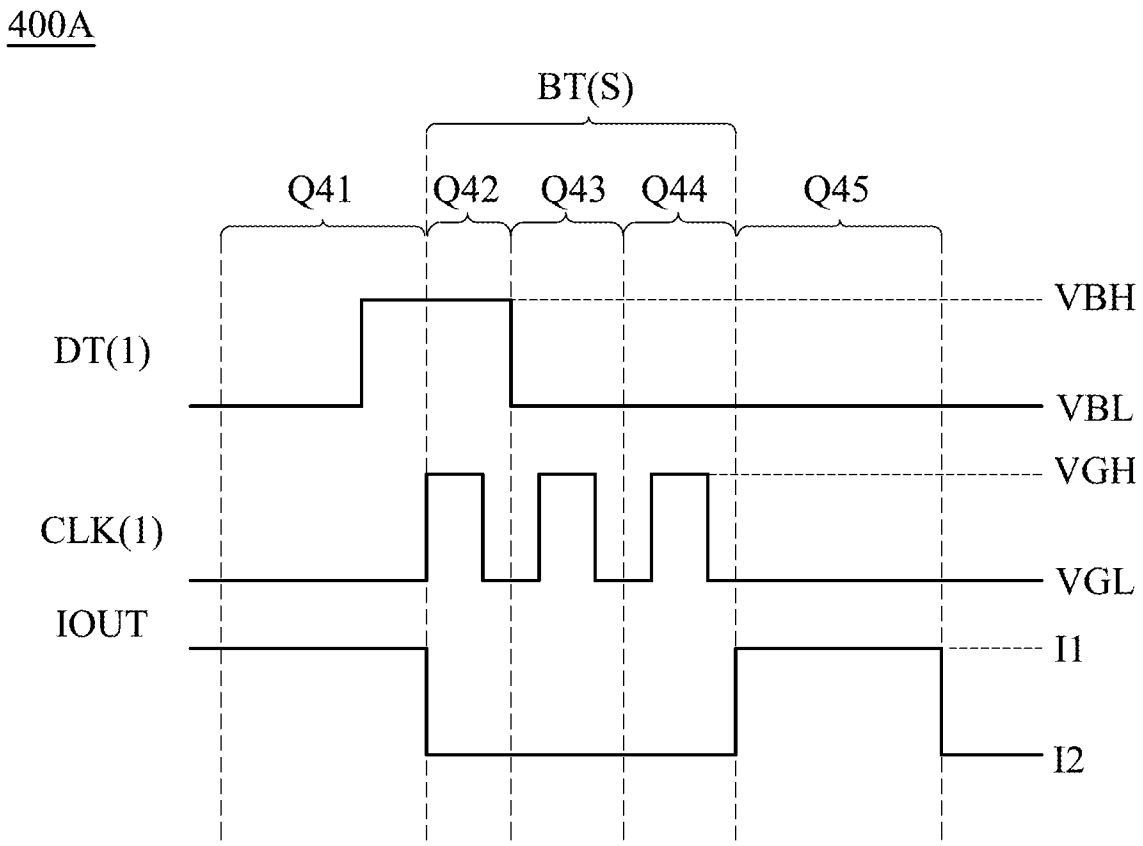
FIG. 4A is a timing diagram of the display performing a light emitting operation according to one embodiment of this disclosure.

FIG. 4A is a timing diagram 400A of the display 200B performing a light emitting operation according to one embodiment of this disclosure. The timing diagram 400A includes periods Q41-Q45 in order. In some embodiments, the timing diagram 400A corresponds to signals shown in FIG. 2B, such as operations of the data signal DT(1) and the clock signal CLK(1).

As shown by way of example in FIG. 4A, during the periods Q42-Q44, the clock signal CLK(1) has the enable voltage level VGH, such that the control circuit 212' generates the light emitting signal EM(1) according to an Sth data bit BT(S) of the data signal DT(1). It is noted that S is an integer larger than one. Correspondingly, during the period Q45, the light emitting circuit 214' performs a light emitting operation according to the light emitting signal EM(1) corresponding to the Sth data bit BT(S). In some embodiments, during the period Q41, the light emitting circuit 214' performs a light emitting operation according to the light emitting signal EM(1) corresponding to an (S−1)th data bit BT(S−1) of the data signal DT(1).

As shown by way of example in FIG. 4A, the clock signal CLK(1) includes three pulses. The three pulses are located at the periods Q42-Q44, respectively. In some embodiments, the control circuit 212' generates the light emitting signal EM(1) according to the data signal DT(1) and the three pulses of the periods Q42-Q44. Further details are described below in embodiments with reference to FIG. 4B.

In some embodiments, the control circuit 212' is further configured to control a current IOUT flowing through the light emitting circuit 214'. In some embodiments, the light emitting circuit 214' configured to be turned on when the current IOUT has a current level 11, and configured to be turned off when the current IOUT has a current level 12. In some embodiments, the current level 11 is higher than the current level 12. In some embodiments, the current level 12 is substantially equal to a zero current level.

In the embodiment shown in FIG. 4A, during the period Q41, the current IOUT has the current level 11, such that light emitting circuit 214' emits light according to the light emitting signal EM(1). During the periods Q42-Q44, the current IOUT has the current level 12, such that light emitting circuit 214' does not emit light. During the period Q45, the current IOUT has the current level 11, such that light emitting circuit 214' emits light according to the light emitting signal EM(1). In other word, the pixel device 210' does not emit light when the control circuit 212' writes the data signal DT(1) according to the clock signal CLK(1) to generate the light emitting signal EM(1).

Figure 4B:
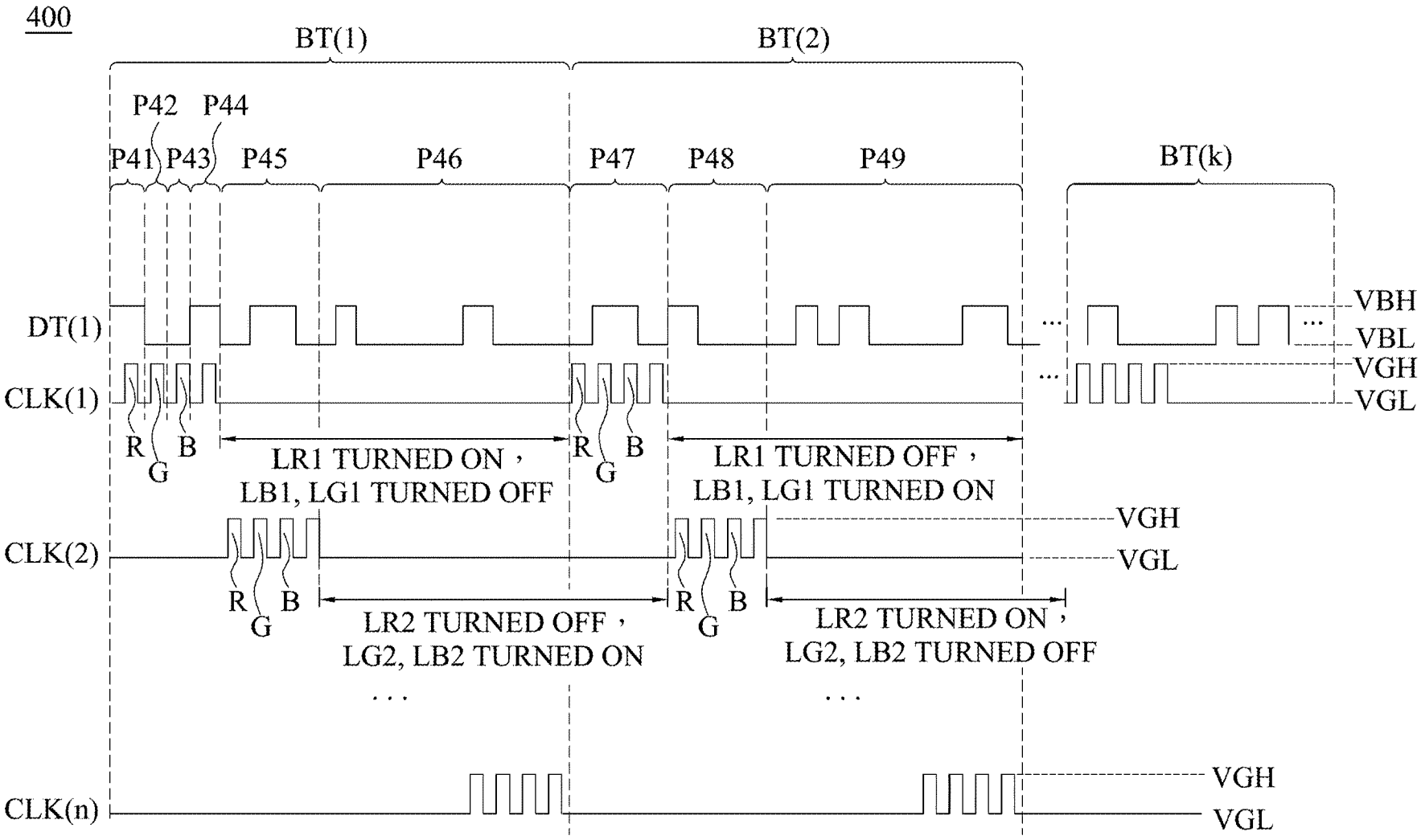
FIG. 4B is a timing diagram of the display performing a light emitting operation according to one embodiment of this disclosure.

FIG. 4B is a timing diagram 400 of the display 200B performing a light emitting operation according to one embodiment of this disclosure. The timing diagram 400 includes periods P41-P49 in order. In some embodiments, the timing diagram 400 corresponds to signals shown in FIG. 2B, such as operations of the data signal DT(1) and the clock signals CLK(1)-CLK(n).

Referring to FIG. 4A and FIG. 4B, the periods P41-P43 correspond to the periods Q42-Q44, respectively, and the periods P45-P46 correspond to the period Q45.

As shown by way of example in FIG. 4B, voltage levels of the data signal DT(1) during the periods P41-P46 correspond to the first data bit BT(1), and voltage levels of the data signal DT(1) during the periods P47-P49 correspond to the second data bit BT(2).

As shown by way of example in FIG. 4B, during the periods P42-P44, the clock signal CLK(1) has the enable voltage level VGH, such that the control circuit 212' generates the light emitting signal EM(1) according to the first data bit BT(1) of the data signal DT(1). Correspondingly, during the period P45-P46, the light emitting circuit 214' performs a light emitting operation according to the light emitting signal EM(1) corresponding to the first data bit BT(1).

As shown by way of example in FIG. 4B, the clock signal CLK(1) includes pulses at the period P41-P44, respectively. In some embodiments, the control circuit 212' generates the light emitting signal EM(1) according to the data signal DT(1) and the three pulses of the periods P41-P43. The light emitting signal EM(1) is configured to control the light emitting elements LR1, LG1 and LB1 to be turned on or not. The three pulses of the periods P41-P43 correspond to the light emitting elements LR1, LG1 and LB1, respectively. In the embodiment shown in FIG. 4B, the three pulses of the clock signals CLK(1) corresponding to the light emitting elements LR1, LG1 and LB1 are labeled by R, G and B, respectively.

More specifically, during the period P41, the control circuit 212' generates the light emitting signal EM(1) according to the data signal DT(1) to control a light emitting operation of the light emitting element LR1 during the periods P45-P46. In the embodiment shown in FIG. 4B, during the period P41, the data signal DT(1) has an enable voltage level VBH. Correspondingly, during the periods P45-P46, the light emitting element LR1 is turned on to perform a light emitting operation.

As shown by way of example in FIG. 4B, during the period P42, the clock signal CLK(1) has an enable voltage level VGH, such that the control circuit 212' generates the light emitting signal EM(1) according to a voltage level of the data signal DT(1) to control a light emitting operation of the light emitting element LG1 during the periods P45-P46. In the embodiment shown in FIG. 4B, during the period P42, the data signal DT(1) has an disable voltage level VBL. Correspondingly, during the periods P45-P46, the light emitting element LG1 is turned off.

As shown by way of example in FIG. 4B, during the period P43, the clock signal CLK(1) has an enable voltage level VGH, such that the control circuit 212' generates the light emitting signal EM(1) according to a voltage level of the data signal DT(1) to control a light emitting operation of the light emitting element LB1 during the periods P45-P46. In the embodiment shown in FIG. 4B, during the period P43, the data signal DT(1) has the disable voltage level VBL. Correspondingly, during the periods P45-P46, the light emitting element LB1 is turned off.

As shown by way of example in FIG. 4B, during the period P44, the clock signal CLK(1) has an enable voltage level VGH, such that the control circuit 212' generates the light emitting signal EM(1) according to a voltage level of the data signal DT(1) to control a current flowing through the light emitting circuit 214' during the periods P45-P46. In the embodiment shown in FIG. 4B, during the period P44, the data signal DT(1) has the enable voltage level VBH. Correspondingly, during the periods P45-P46, the current flowing through the light emitting circuit 214' has a first current level, such that the light emitting element LR1 in the light emitting circuit 214' emits light with a first brightness level corresponding to the first current level.

In other embodiments, during the period P44, the data signal DT(1) has the disable voltage level VBL. Correspondingly, during the periods P45-P46, the current flowing through the light emitting circuit 214' has a second current level, such that the light emitting circuit 214' emits light with a second brightness level corresponding to the second current level.

As shown by way of example in FIG. 4B, during the period P45, the clock signal CLK(2) has an enable voltage level VGH, such that the control circuit 222' generates the light emitting signal EM(2) according to the first data bit BT(1) of the data signal DT(1). Correspondingly, during the periods P46-P47, the light emitting circuit 224' performs a light emitting operation according to the light emitting signal EM(2) corresponding to the first data bit BT(1).

In some embodiments, the operations of the control circuit 222' and the light emitting circuit 224' according to the clock signal CLK(2) during the periods P45-P47 are similar to the operations of the control circuit 212' and the light emitting circuit 214' according to the clock signal CLK(1) during the periods P41-P46. Therefore, similar aspects of these operations are not repeated for brevity.

As shown by way of example in FIG. 4B, the clock signal CLK(2) includes four pulses. First three pulses correspond to the light emitting operations during the periods P46-P47 of the light emitting elements LR2, LG2 and LB2, respectively. In the embodiment shown in FIG. 4B, the three pulses of the clock signal CLK(2) corresponding to the light emitting elements LR2, LG2 and LB2 are labeled by R, G and B, respectively.

As shown by way of example in FIG. 4B, during the period P45, the data signal DT(1) corresponding to the pulses of the light emitting elements LG2 and LB2 have the enable voltage level VBH, and the data signal DT(1) corresponding to the pulse of the light emitting element LR2 has the disable voltage level VBL. Correspondingly, during the periods P46-P47, the light emitting elements LG2 and LB2 are turned on to emit light, and the light emitting element LR2 is turned off.

In some embodiments, during the period P45, the fourth pulse of the clock signal CLK(2) corresponds to the current flowing through the light emitting circuit 224' during the periods P46-P47. As shown by way of example in FIG. 4B, the pulse of the data signal DT(1) corresponding to the current has the disable voltage level VBL. Correspondingly, during the periods P46-P47, the current flowing through the light emitting circuit 224' has the second current level, such that the light emitting elements LG2 and LB2 emit light with the second brightness level corresponding to the second current level.

In some embodiments, during the period P46, other pixel devices in the pixel device group 250 receive the first bit BT(1) of the data signal DT(1) according to the clock signals CLK(3)-CLK(n), and generate the light emitting signals EM(3)-EM(n) correspondingly to perform light emitting operations.

As shown by way of example in FIG. 4B, during the period P47, the clock signal CLK(1) has an enable voltage level VGH, such that the control circuit 212' generates the light emitting signal EM(1) according to the second data bit BT(2) of the data signal DT(1). Correspondingly, during the periods P48-P49, the light emitting circuit 214' performs light emitting operations according to the light emitting signal EM(1) corresponding to the second data bit BT(2).

In some embodiments, the operations of the control circuit 212' and the light emitting circuit 214' corresponding to the second data bit BT(2) during the periods P47-P49 are similar to the operations corresponding to the first data bit BT(1) during the periods P41-P46. Therefore, similar aspects of these operations are not repeated for brevity.

As shown by way of example in FIG. 4B, during the period P47, the clock signal CLK(1) includes four pulses. First three pulses correspond to the light emitting operations during the periods P48-P49 of the light emitting elements LR1, LG1 and LB1, respectively. In the embodiment shown in FIG. 4B, the three pulses of the clock signal CLK(1) corresponding to the light emitting elements LR2, LG2 and LB2 are labeled by R, G and B, respectively.

As shown by way of example in FIG. 4B, during the period P47, the data signal DT(1) corresponding to the pulses of the light emitting elements LG1 and LB1 have the enable voltage level VBH, and the data signal DT(1) corresponding to the pulse of the light emitting element LR1 has the disable voltage level VBL. Correspondingly, during the periods P48-P49, the light emitting elements LG1 and LB1 are turned on to emit light, and the light emitting element LR1 is turned off.

In some embodiments, during the period P47, the light emitting circuit 214' does not perform light emitting operations, and the light emitting circuit 224' performs light emitting operations according to the first data bit BT(1).

In the embodiment shown in FIG. 4B, during the period P48, the clock signal CLK(2) has an enable voltage level VGH, such that the control circuit 222' generates the light emitting signal EM(2) according to the second data bit BT(2) of the data signal DT(1). Correspondingly, during the period P49, the light emitting circuit 224' performs light emitting operations according to the light emitting signal EM(2) corresponding to the second data bit BT(2).

In some embodiments, the operations of the control circuit 222' and the light emitting circuit 224' according to the clock signal CLK(2) during the periods P48-P49 are similar to the operations the control circuit 212' and the light emitting circuit 214' according to the clock signal CLK(1) during the periods P47-P48. Therefore, similar aspects of these operations are not repeated for brevity.

As shown by way of example in FIG. 4B, during the period P48, the clock signal CLK(2) includes four pulses. First three pulses correspond to the light emitting operations during the period P49 of the light emitting elements LR2, LG2 and LB2, respectively. In the embodiment shown in FIG. 4B, the three pulses of the clock signal CLK(2) corresponding to the light emitting elements LR2, LG2 and LB2 are labeled by R, G and B, respectively.

As shown by way of example in FIG. 4B, during the period P48, the data signal DT(1) corresponding to the pulses of the light emitting elements LG2 and LB2 have the disable voltage level VBL, and the data signal DT(1) corresponding to the pulse of the light emitting element LR2 has the enable voltage level VBH. Correspondingly, during the periods P49, the light emitting elements LG1 and LB1 are turned off, and the light emitting element LR1 is turned on to emit light.

In the embodiment shown in FIG. 4B, during the period P48, the light emitting circuit 224' does not perform light emitting operations, and the light emitting circuit 214' performs light emitting operations according to the second data bit BT(2).

As shown by way of example in FIG. 4B, during the period P49, the light emitting circuits 214' and 224' performs light emitting operations according to the second data bit BT(2) of the data signal DT(1).

In some embodiments, during the period P49, other pixel devices in the pixel device group 250 receive the second bit BT(2) of the data signal DT(1) according to the clock signals CLK(3)-CLK(n), and generate the light emitting signals EM(3)-EM(n) correspondingly to perform light emitting operations.

In some embodiments, after the period P49, the pixel device group 250 perform light emitting operations according to the third data bit BT(3) to the kth data bit BT(k) in order.

In some previous approaches, a display includes multiple pixel devices, and the pixel devices are configured to receive a single data signal to emit light in turns according to corresponding scanning signals. In the approaches described above, a light emitting time of each of the pixel devices are shorter, a larger current is required to maintain the brightness of the display, and the display suffers from serious strobe problems.

Compared to the above approaches, in some embodiments of the present disclosure, the light emitting circuits in the display 200B emit light simultaneously, such as the light emitting circuits emitting light simultaneously during the periods P46 and P49. As a result, the current required for emitting light is smaller, the strobe problems are reduced, and the quality of the screen is improved.

Figure 5A:
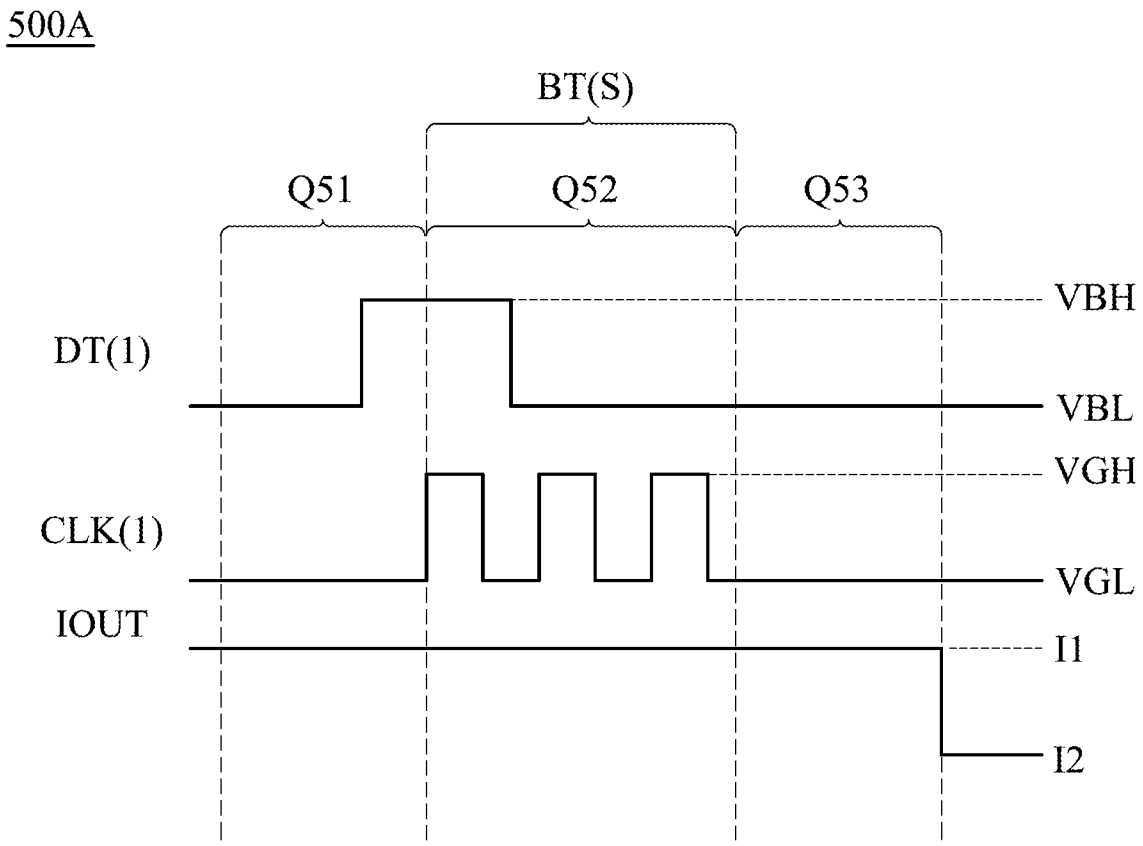
FIG. 5A is a timing diagram of the display performing a light emitting operation according to one embodiment of this disclosure.

FIG. 5A is a timing diagram 500A of the display 200B performing a light emitting operation according to one embodiment of this disclosure. The timing diagram 500A includes periods Q51-Q53 in order. The timing diagram 500A is an alternative embodiment of the timing diagram 400A shown in FIG. 4A. Operations of the periods Q51-Q53 are similar to the operations of the periods Q41-Q45, in which the period Q52 corresponds to the periods Q42-Q44, and the periods Q51 and Q53 correspond to the periods Q41 and Q45, respectively. Therefore, similar aspects of these operations are not repeated for brevity.

In the embodiment shown in FIG. 5A, during the periods Q51-Q53, the current IOUT has the current level 11, such that light emitting circuit 214' emits light according to the light emitting signal EM(1). In other words, in the embodiment shown in FIG. 5A, the pixel device 210' emits light continuously when the control circuit 212' writes the data signal DT(1) according to the clock signal CLK(1).

In different embodiments, users may select the operations corresponding to the timing diagrams 400A or 500A according to different conditions, such that the pixel device 210' emits light or not when the control circuit 212' writes the data signal DT(1).

Figure 5B:
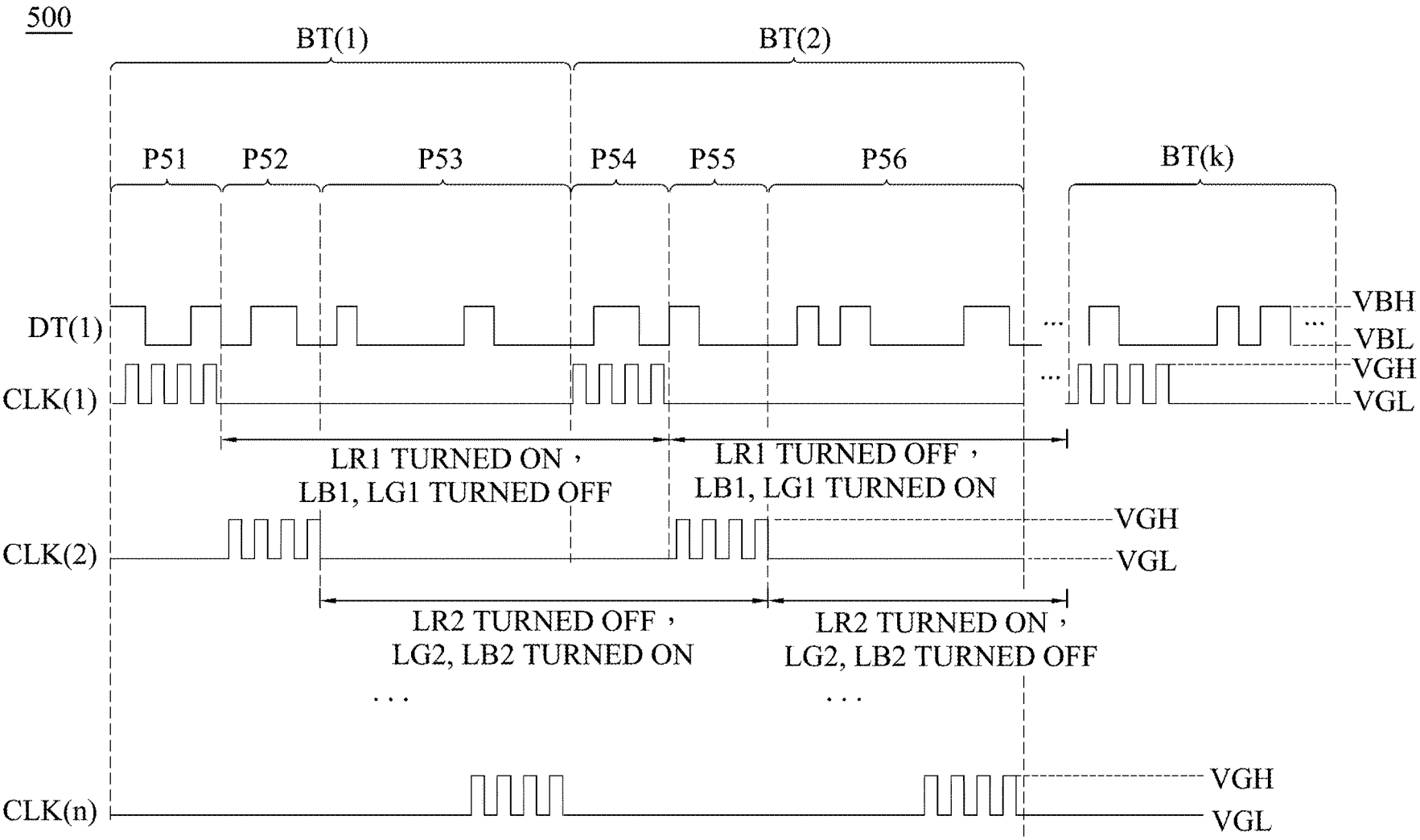
FIG. 5B is a timing diagram of the display performing a light emitting operation according to one embodiment of this disclosure.

FIG. 5B is a timing diagram 500 of the display 200B performing a light emitting operation according to one embodiment of this disclosure. The timing diagram 500 includes periods P51-P56 in order. The timing diagram 500 is an alternative embodiment of the timing diagram 400 shown in FIG. 4B. Operations of the periods P51-P56 are similar to the operations of the periods P41-P49, in which the period P51 corresponds to the periods P41-P44, and the periods P52-P56 correspond to the periods P45-P49, respectively. Therefore, similar aspects of these operations are not repeated for brevity.

As shown by way of example in FIG. 5B, during the period P54, the control circuit 212' generates the light emitting signal EM(1) according to the second data bit BT(2) of the data signal DT(1). At this moment, the light emitting circuit 214' performs light emitting operations according to the first data bit BT(1). In other words, the light emitting circuit 214' performs light emitting operations according to the first data bit BT(1) during the periods P52-P54.

Similarly, during the period P55, the control circuit 222' generates the light emitting signal EM(2) according to the second data bit BT(2). At this moment, the light emitting circuit 224' performs light emitting operations according to the first data bit BT(1). In other words, the light emitting circuit 224' performs light emitting operations according to the first data bit BT(1) during the periods P53-P55.

In the embodiment shown in FIG. 5B, during the periods P53-P54, the light emitting circuits 214' and 224' perform the light emitting operations according to the first data bit BT(1).

Comparing to FIG. 4B, in the embodiment shown in FIG. 5B, the light emitting circuits 214' and 224' emit light continuously when the control circuits 212' and 222' generate the light emitting signals EM(1) and EM(2) according to next data bit, and change light emitting states according to the light emitting signals EM(1) and EM(2) hereafter.

Figure 6:
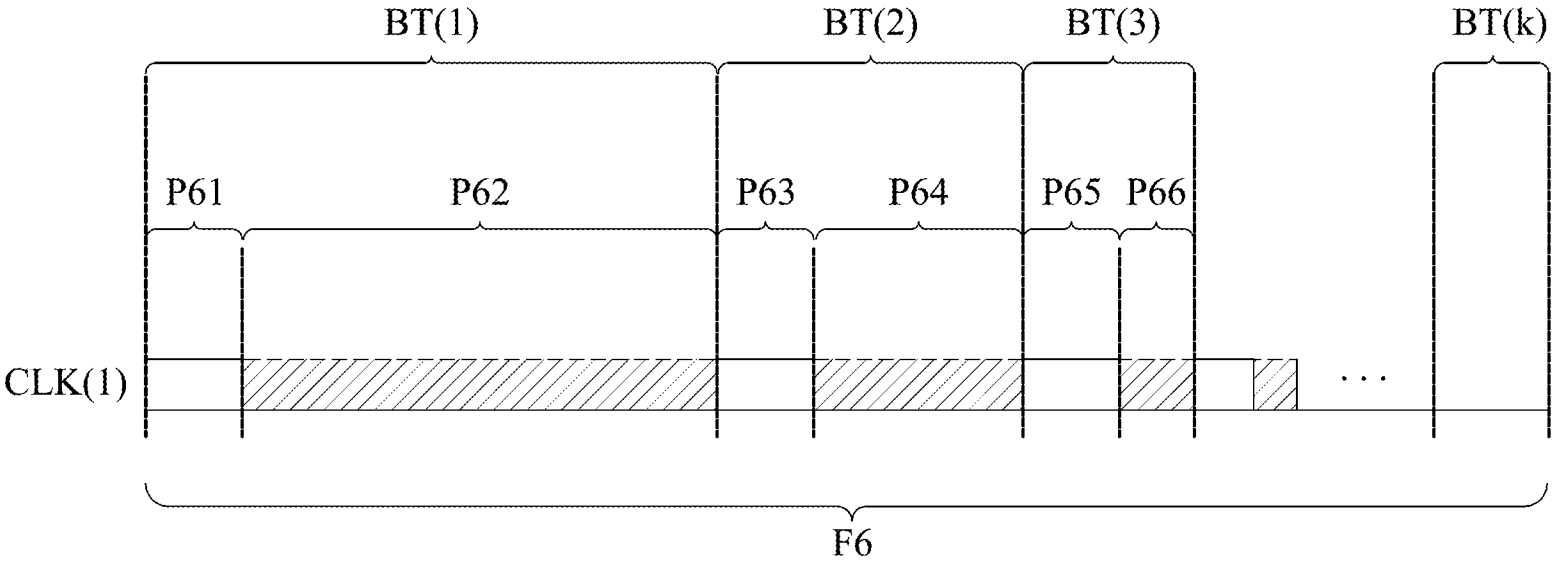
FIG. 6 is a timing diagram of the pixel device performing a light emitting operation according to one embodiment of this disclosure.

FIG. 6 is a timing diagram 600 of the pixel device performing a light emitting operation according to one embodiment of this disclosure. The timing diagram 600 is an alternative embodiment of the timing diagram 400 shown in FIG. 4B. The timing diagram 600 illustrates operations of the clock signal CLK(1) during a frame time F6. The frame time F6 includes periods P61-P66 in order. Operations of the clock signal CLK(1) during the periods P61-P64 are similar to the operations during the periods P41-P44, in which the period P61 corresponds to the periods P41-P44, the period P62 corresponds to the periods P45-P46, the period P63 corresponds to the period P47, and the period P64 correspond to the periods P48-P49. Therefore, similar aspects of these operations are not repeated for brevity.

As shown by way of example in FIG. 6, during the period P61, the clock signal CLK(1) has an enable voltage level VGH, such that the control circuit 212' generates the light emitting signal EM(1) according to the first data bit BT(1). Correspondingly, during the period P62, the light emitting circuit 214' performs a light emitting operation according to the light emitting signal EM(1) corresponding to the first data bit BT(1).

Similarly, during the periods P63-P64, the pixel device 210' performs a light emitting operation according to the second data bit BT(2) of the data signal DT(1). During the periods P65-P66, the pixel device 210' performs a light emitting operation according to the third data bit BT(3) of the data signal DT(1), and so on. During the frame time F6 shown in FIG. 6, the pixel device 210' performs light emitting operations according to the first data bit BT(1) to the kth data bit BT(k) in order.

In some embodiments, during the periods P61, P63 and P65, the data signal DT(1) is written into the pixel device 210' to control the light emitting circuit 214', and thus the periods P61, P63 and P65 are referred to as writing periods. During the periods P62, P64 and P66, the light emitting circuit 214' emits light according to the data signal DT(1), and thus the periods P62, P64 and P66 are referred to as light emitting periods.

In some embodiments, during the frame time F6, time lengths of periods of light emitting operations corresponding to each of the first data bit BT(1) to the kth data bit BT(k) are arranged in order in descending power.

For example, a time length of the periods P61-P62 corresponding to the first data bit BT(1) is twice of a time length of the periods P63-P64 corresponding to the second data bit BT(2), and a time length of the periods P63-P64 corresponding to the second data bit BT(2) is twice of a time length of the periods P65-P66 corresponding to the third data bit BT(3), and so on. During the frame time F6, a time length corresponding to the ith data bit BT(i) is twice of a time length corresponding to the (i+1)th data bit BT(i+1). It is noted that i is a positive integer smaller than k.

In the embodiment shown in FIG. 6, each one of the time lengths of the writing periods and the light emitting periods corresponding to the first data bit BT(1) to the kth data bit BT(k) is twice of the former one, but the present disclosure is not limited to such embodiments. In various embodiments, the time lengths of the writing periods and the light emitting periods may have different numerical relationships.

Figure 7:
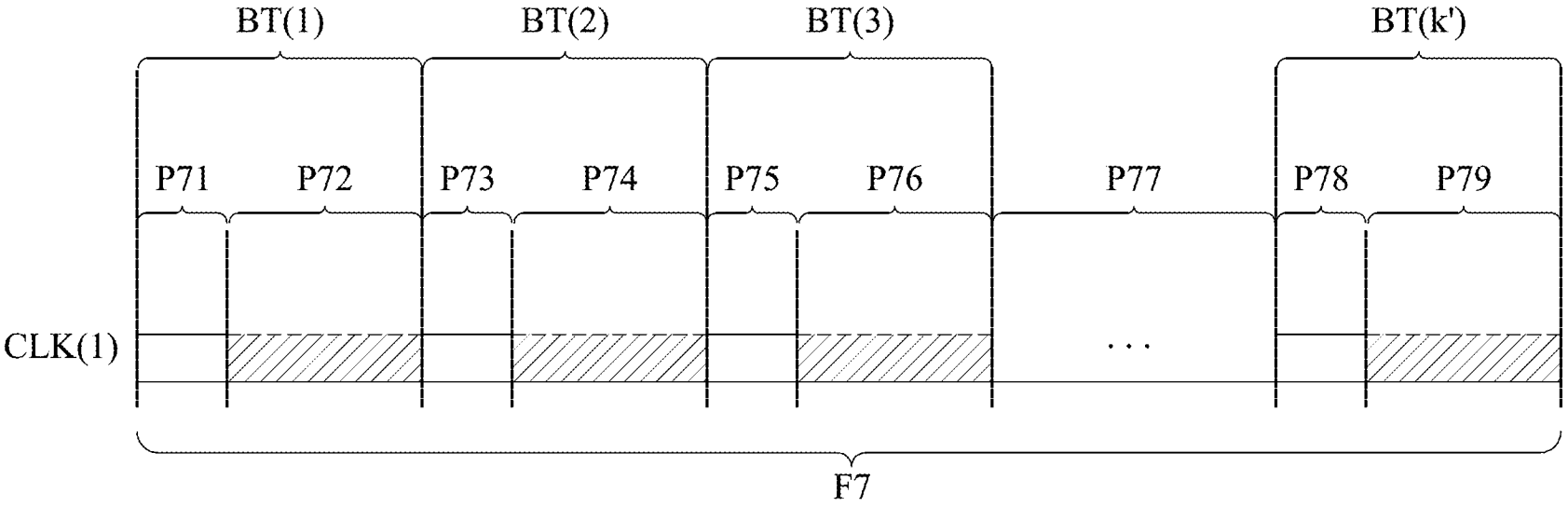
FIG. 7 is a timing diagram of the pixel device performing a light emitting operation according to one embodiment of this disclosure.

FIG. 7 is a timing diagram 700 of the pixel device performing a light emitting operation according to one embodiment of this disclosure. The timing diagram 700 is an alternative embodiment of the timing diagram 600 shown in FIG. 6. The timing diagram 700 illustrates operations of the clock signal CLK(1) during a frame time F7. The frame time F7 includes periods P71-P79 in order. Operations of the clock signal CLK(1) during the periods P71-P76 are similar to the operations during the periods P61-P66, in which the periods P71-P76 corresponds to the periods P61-P66, respectively. Therefore, similar aspects of these operations are not repeated for brevity.

As shown by way of example in FIG. 7, during the periods P71-P72, the pixel device 210' performs a light emitting operation according to the first data bit BT(1) of the data signal DT(1). During the periods P73-P74, the pixel device 210' performs a light emitting operation according to the second data bit BT(2) of the data signal DT(1). During the periods P75-P76, the pixel device 210' performs a light emitting operation according to the third data bit BT(3) of the data signal DT(1), and so on. During the frame time F7 shown in FIG. 7, the pixel device 210' performs light emitting operations according to the first data bit BT(1) to the k'th data bit BT(k') in order. It is noted that k' is a positive integer. During the period P77, the pixel device 210' performs light emitting operations according to the fourth data bit BT(4) to the (k'−1)th data bit BT(k'−1) of the data signal DT(1). During the periods P78-P79, the pixel device 210' performs a light emitting operation according to the k'th data bit BT(k') of the data signal DT(1).

In some embodiments, during the periods P71, P73, P75 and P78, the data signal DT(1) is written into the pixel device 210' to control the light emitting circuit 214', and thus the periods P71, P73, P75 and P78 are referred to as writing periods. During the periods P72, P74, P76 and P79, the light emitting circuit 214' emits light according to the data signal DT(1), and thus the periods P72, P74, P76 and P79 are referred to as light emitting periods.

In some embodiments, during the frame time F7, time lengths of periods of light emitting operations corresponding to each of the first data bit BT(1) to the k'th data bit BT(k') are same. For example, each of a time length of the periods P71-P72 corresponding to the first data bit BT(1), a time length of the periods P73-P74 corresponding to the second data bit BT(2), a time length of the periods P75-P76 corresponding to the third data bit BT(3) and a time length of the periods P78-P79 corresponding to the k' data bit BT(k') are same as each other.

In some embodiments, a time length of each of the writing periods and each of the light emitting periods is substantially equal to one-k'th of a time length of the frame time F7. For example, k' times of the time length of the periods P71-P72 is equal to the time length of the frame time F7.

Figure 8:
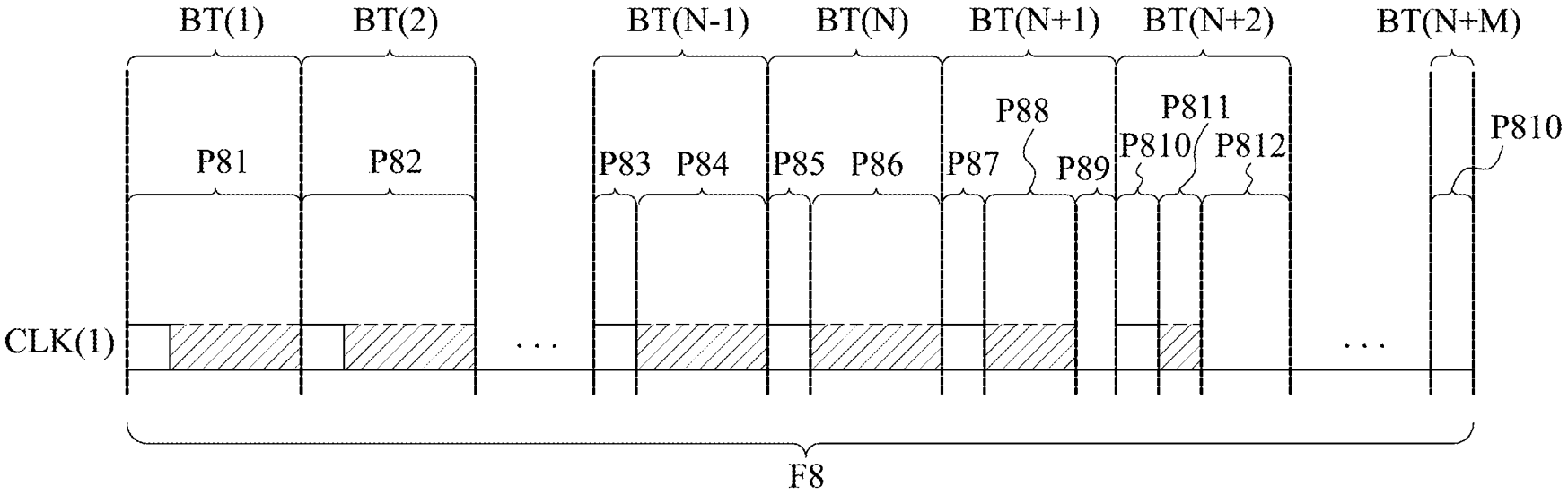
FIG. 8 is a timing diagram of the pixel device performing a light emitting operation according to one embodiment of this disclosure.

FIG. 8 is a timing diagram 800 of the pixel device performing a light emitting operation according to one embodiment of this disclosure. The timing diagram 800 is an alternative embodiment of the timing diagram 700 shown in FIG. 7. The timing diagram 800 illustrates operations of the clock signal CLK(1) during a frame time F8. The frame time F8 includes periods P81-P813 in order.

As shown by way of example in FIG. 8, during the frame time F8, the pixel device 210' performs light emitting operations according to the first data bit BT(1) to an (N+M) th data bit BT(N+M) in order. It is noted that N and M are positive integers.

In some embodiments, a period corresponding to each of the first data bit BT(1) to the (N+M)th data bit BT(N+M) includes a writing period and a light emitting period. For example, the periods P83, P85, P87 and P810 correspond to writing periods of the data bits BT(N−1), BT(N), BT(N+1) and BT(N+2), respectively, and the periods P84, P86, P88 and P811 correspond to light emitting periods of the data bits BT(N−1), BT(N), BT(N+1) and BT(N+2), respectively.

Referring to FIG. 7 and FIG. 8, operations of the data bits BT(1)-BT(N) during the periods P81-P86 are similar to the operations of the data bits BT(1)-BT(k') during the periods P71-P79. Therefore, similar aspects of these operations are not repeated for brevity.

In some embodiments, a time length of each of the periods corresponding to the data bits BT(1)-BT(N) are same as each other. For example, a time length of the period P81 corresponds the data bit BT(1), a time length of the period P82 corresponds the data bit BT(2), a time length of the periods P83-P84 corresponds the data bit BT(N−1), and a time length of the periods P85-P86 corresponds the data bit BT(N) are same as each other.

As shown by way of example in FIG. 8, during the period P87, the clock signal CLK(1) has an enable voltage level VGH, such that the control circuit 212' generates the light emitting signal EM(1) according to the (N+1)th data bit BT(N+1). Correspondingly, during the period P88, the light emitting circuit 214' performs a light emitting operation according to the light emitting signal EM(1) corresponding to the (N+1)th data bit BT(N+1).

In some embodiments, a period corresponding to each of the (N+1)th data bit BT(N+1) to the (N+M)th data bit BT(N+M) further includes a disable period. The light emitting circuit 214' does not emit light during the disable period. For example, the periods P89 and P812 correspond to disable periods of the data bits BT(N+1) and BT(N+2), respectively. During the periods P89 and P812 the light emitting circuit 214' does not emit light.

In some embodiments, time lengths of the writing periods and the light emitting periods of the (N+1)th data bit BT(N+1) to the (N+M)th data bit BT(N+M) are arranged in order in descending power.

For example, a time length of the writing period P85 and the light emitting period P86 corresponding to the (N)th data bit BT(N) is twice of a time length of the writing period P87 and the light emitting period P88 corresponding to the (N+1)th data bit BT(N+1), and a time length of the periods P87-P88 is twice of a time length of the writing period P810 and the light emitting period P811 corresponding to the (N+2)th data bit BT(N+2), and so on. During the frame time F8, a time length corresponding to the (N+L)th data bit BT(N+L) is half of a time length corresponding to the (N+L−1)th data bit BT(N+L−1). It is noted that L is a positive integer smaller than or equal to M. In some embodiments, a time length of the periods P85-P86 is $2^M$ times of a time length of a writing period and a light emitting period in the period P813 corresponding to the (N+M)th data bit BT(N+M).

In some embodiments, the time lengths of the periods of each of the data bits BT(1)-BT(N+M) are same as each other. The period corresponding to each of the data bits BT(1)-BT(N) includes a writing period and a light emitting period, and the period corresponding to each of the data bits BT(N+1)-BT(N+M) includes a writing period, a light emitting period and a disable period.

For example, a time length of the writing period P85 and the light emitting period P86 corresponding to the data bit BT(N), a time length of the writing period P87, the light emitting period P88 and the disable period P89 corresponding to the data bit BT(N+1), and a time length of the writing period P810, the light emitting period P812 and the disable period P813 corresponding to the data bit BT(N+2) same as each other.

In some embodiments, a time length of the frame time F8 is (N+M) times of a time length of a period corresponding to one of the data bits BT(1)-BT(N+M). For example, the time length of the frame time F8 is equal to (N+M) times of the time length of the period P81 corresponding to the data bit BT(1), and also equal to (N+M) times of the time length of the periods P87-P89 corresponding to the data bit BT(N+1).

In summary, in the embodiments of the present disclosure, a frame time is separated into multiple sub-periods. The ways of the light emitting circuit 214' emitting light can be updated during each of the sub-periods, such that the operations of the light emitting circuit 214' have higher flexibility. Furthermore, in the embodiments of the present disclosure, multiple light emitting circuits in the display 200B emit light simultaneously. As a result, the current required for emitting light is smaller, the strobe problems are reduced, and the quality of the screen is improved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display, comprising pixel devices coupled to each other in series, the pixel devices comprising:

a first pixel device comprising:

a first control circuit configured to generate a first light emitting signal according to a first clock signal and a data signal during a first period; and a first light emitting circuit being coupled to the first control circuit and configured to emit light according to the first light emitting signal during a second period and a third period; and a second pixel device comprising:

a second control circuit configured to generate a second light emitting signal according to a second clock signal and the data signal during the second period; and a second light emitting circuit being coupled to the second control circuit and configured to emit light according to the second light emitting signal during the third period, wherein the first period to the third period are arranged continuously in order.

2. The display of claim 1, wherein the first control circuit is further configured to generate the first light emitting signal according to the first clock signal and the data signal during a fourth period, the first light emitting circuit is further configured to emit light according to the first light emitting signal during a fifth period, the second light emitting circuit is further configured to emit light according to the second light emitting signal during the fourth period, and wherein the first period to the fifth period are arranged continuously in order.

3. The display of claim 2, wherein light emitting operations of the first light emitting circuit during the second period and the third period correspond to a first bit of the data signal, and a light emitting operation of the first light emitting circuit during the fifth period corresponds to a second bit of the data signal.

4. The display of claim 2, wherein the second control circuit is further configured to generate the second light emitting signal according to the second clock signal and the data signal during the fifth period, the second light emitting circuit is further configured to emit light according to the second light emitting signal during a sixth period, and wherein the first period to the sixth period are arranged continuously in order.

5. The display of claim 4, wherein light emitting operations of the first light emitting circuit and the second light emitting circuit during the third period correspond to a first bit of the data signal, and light emitting operations of the first light emitting circuit the second light emitting circuit during the sixth period correspond to a second bit of the data signal.

6. The display of claim 2, wherein the first light emitting circuit doesn't emit light during the fourth period.

7. The display of claim 2, wherein the first light emitting circuit is further configured to emit light according to the first light emitting signal during the fourth period, and light emitting operations of the first light emitting circuit during the second period to the fourth period correspond to a first bit of the data signal.

8. The display of claim 1, wherein the first control circuit is further configured to generate the first light emitting signal according to the first clock signal and the data signal during a fourth period, the first light emitting circuit is further configured to emit light according to the first light emitting signal during a fifth period, the first period to the fifth period are arranged continuously in order, and a time length of the first period to the third period is substantially equal to twice of a time length of the fourth period to the fifth period.

9. The display of claim 1, wherein the first control circuit is further configured to control the first light emitting circuit according to a first bit to an Nth bit of the data signal during a first writing period to an Nth writing period in a frame time, the first light emitting circuit is further configured to emit light according to the first bit to the Nth bit during a first light emitting period to an Nth light emitting period in the frame time, the first writing period to the Nth writing period and the first light emitting period to the Nth light emitting period are arranged alternatively in the frame time, a time length of an Mth writing period and an Mth light emitting period is substantially equal to twice of a time length of an (M+1)th writing period and an (M+1)th light emitting period, wherein N is an integer larger than or equal to two, M is an integer less than N, and the first period corresponds to the Mth writing period, and the second period to the third period corresponds to the Mth light emitting period.

10. The display of claim 1, wherein the first control circuit is further configured to control the first light emitting circuit according to a first bit to an Nth bit of the data signal during a first writing period to an Nth writing period in a frame time, the first light emitting circuit is further configured to emit light according to the first bit to the Nth bit during a first light emitting period to an Nth light emitting period in the frame time, the first writing period to the Nth writing period and the first light emitting period to the Nth light emitting period are arranged alternatively in the frame time, a time length of each writing period of the first writing period to the Nth writing period and each light emitting period of the first light emitting period to the Nth light emitting period is substantially equal to one-Nth of a time length of the frame time, wherein N is an integer larger than or equal to two, and the first period corresponds to one of the first writing period to the Nth writing period, and the second period to the third period corresponds to one of the first light emitting period to the Nth light emitting period.

11. The display of claim 1, wherein the first control circuit is further configured to generate the first light emitting signal according to the first clock signal and the data signal during a fourth period and a fifth period, the first light emitting circuit is further configured to emit light according to the first light emitting signal during a sixth period and a seventh period, the first period to the fourth period, the sixth period, the fifth period and the seventh period are arranged continuously in order, a time length of the first period to the third period is substantially equal to a time length of the fourth period and the sixth period, and a time length of the fourth period and the sixth period is substantially equal to twice of a time length of the fifth period and the seventh period.

12. The display of claim 11, wherein the first control circuit is further configured to generate the first light emitting signal according to the first clock signal and the data signal during an eighth period, the first light emitting circuit is further configured to emit light according to the first light emitting signal during a ninth period, and configured to stop emitting light during a tenth period, the seventh period, the tenth period, the eighth period and the ninth period are arranged continuously in order, and a time length of the fourth period and the sixth period is substantially equal to a time length of the fifth period, the seventh period and the tenth period.

13. The display of claim 1, wherein the first control circuit is further configured to control the first light emitting circuit according to a first bit to an (N+M)th bit of the data signal during a first writing period to an (N+M)th writing period in a frame time, the first light emitting circuit is further configured to emit light according to the first bit to the (N+M)th bit during a first light emitting period to an (N+M)th light emitting period in the frame time, the first writing period to the (N+M)th writing period and the first light emitting period to the (N+M)th light emitting period are arranged alternatively in the frame time, a time length of each writing period of the first writing period to the Nth writing period and each light emitting period of the first light emitting period to the Nth light emitting period is substantially equal to one-(N+M)th of a time length of the frame time, and a time length of an (N+L)th writing period and an (N+L)th light emitting period is an half of a time length of an (N+L−1)th writing period and an (N+L−1)th light emitting period, wherein N and M are positive integers, L is a positive integer less than or equal to M.

14. The display of claim 13, wherein the first light emitting circuit does not emit light during a first disable period to an Mth disable period in the frame time, a Lth disable period is arranged after the (N+L)th light emitting period continuously, and a time length of the Lth disable period, the (N+L)th writing period and the (N+L)th light emitting period is substantially equal to one-(N+M)th of the time length of the frame time.

15. A display, comprising pixel devices coupled to each other in series, the pixel devices comprising:

a first pixel device comprising:

a first control circuit configured to output a first bit of a data signal according to a first clock signal during a first period; and a first light emitting circuit being coupled to the first control circuit and configured to emit light according to the first bit during a second period and a third period; and a second pixel device comprising:

a second control circuit configured to output the first bit according to a second clock signal during the second period; and a second light emitting circuit being coupled to the second control circuit and configured to emit light according to the first bit during the third period and a fourth period; and wherein the first control circuit is further configured to output a second bit of the data signal according to the first clock signal during the fourth period, and the first period to the fourth period are arranged continuously in order.

16. The display of claim 15, wherein the first light emitting circuit is further configured to emit light according to the second bit during a fifth period and a sixth period, the second control circuit is further configured to output the second bit according to the second clock signal during the fifth period the second light emitting circuit is further configured to emit light according to the second bit during the sixth period, and wherein the first period to the sixth period are arranged continuously in order.

17. The display of claim 16, wherein the first light emitting circuit is further configured to emit light according to the first bit during the fourth period, and the second light emitting circuit is further configured to emit light according to the first bit during the fifth period.

18. The display of claim 15, wherein the first control circuit is further configured to output the first bit, the second bit and a third bit to the Nth bit of the data signal according to the first clock signal during a first writing period to an Nth writing period in a frame time, wherein N is an integer larger than or equal to three, the first light emitting circuit is further configured to emit light according to the first bit to the Nth bit during a first light emitting period to an Nth light emitting period in the frame time, the first writing period to the Nth writing period and the first light emitting period to the Nth light emitting period are arranged alternatively in the frame time, and the first period and the fourth period correspond to an Mth writing period and an (M+1)th writing period, respectively, and the second period and the third period correspond to an Mth light emitting period, wherein M is a positive integer less than N.

19. The display of claim 18, wherein a time length of the Mth writing period and the Mth light emitting period is substantially equal to twice of a time length of the (M+1)th writing period and the (M+1)th light emitting period.

20. The display of claim 18, wherein a time length of the Mth writing period and the Mth light emitting period is substantially equal to a time length of the (M+1)th writing period and the (M+1)th light emitting period, a time length of the (M+1)th writing period and the (M+1)th light emitting period is substantially equal to a time length of an (M+2)th writing period and an (M+2)th light emitting period, and M is a positive integer less than (N−1).

* * * * *